US005816278A

United States Patent [19]

Kim

[11] Patent Number: 5,816,278

[45] Date of Patent: Oct. 6, 1998

[54] COLLAPSIBLE TENT

[76] Inventor: Gyeong S. Kim, Kyung-KiDo, Soowon, Jangan-Ku, Eiljun-Gong 176-8, Rep. of Korea

[21] Appl. No.: 822,193

[22] Filed: Mar. 20, 1997

[51] Int. Cl.[6] ..... E04H 15/44

[52] U.S. Cl. ..... 135/126; 135/117; 135/905

[58] Field of Search ..... 135/123, 124, 135/125, 126, 115, 117, 128, 97, 905

[56] References Cited

U.S. PATENT DOCUMENTS

| | | | |
|---|---|---|---|
| 3,990,463 | 11/1976 | Norman | 135/126 |
| 4,128,104 | 12/1978 | Corey | 135/124 |
| 4,825,892 | 5/1989 | Norman | 135/126 |
| 5,038,812 | 8/1991 | Norman | 135/126 |
| 5,137,044 | 8/1992 | Brady | 135/126 |

FOREIGN PATENT DOCUMENTS

| | | | |
|---|---|---|---|
| 2635136 | 2/1990 | France | 135/126 |
| 3-21779 | 1/1991 | Japan | 135/126 |

*Primary Examiner*—Winnie S. Yip
*Attorney, Agent, or Firm*—John K. Park; Law Offices of John K. Park & Associates

[57] ABSTRACT

A collapsible tent including a closed loop resilient coilable member, the member being distorted to form at least three support loops. Each support loop adjoins the other support loops along a single portion of its perimeter with the support loops having a common adjoining region. Each support loop has a perimeter substantially the same as that of the other support loops and a membrane attached to the perimeter of the support loop. The membrane extends between the opposing portions of the support loop to restrain the support loop. The tent further includes a base membrane attached to the perimeters of the support loops and extending between the support loops to restrain the support loops in relation to one another. When the tent is expanded, the support loops are in spaced relation to one another around the common adjoining region and are restrained by the membranes. The common adjoining region forms an apex of the tent and the membranes define walls and a base of the tent. When the tent is fully collapsed, the support loops form overlapping loops over one another that are coiled.

19 Claims, 7 Drawing Sheets

COLLAPSIBLE TENT

BACKGROUND

The present invention relates generally to tents and in particular to collapsible portable tents.

With the substantial increase in out door activities such as camping, many campers utilize tents as temporary shelter. Conventional tents typically include a weather resistant flexible membrane which is supported by polls and anchored to the ground by rope lines. A major problem with conventional tents is the complexity of erecting and collapsing them. To erect a tent, a user must first unfold and lay out the tent membrane on the ground, plan anchoring points for the tent on the ground, attach anchoring ropes to the anchor points, plant a support pole on the ground to support the apex of the tent, lift the tent membrane off the ground and place its apex on the support poll, and restrain the tent membrane by adjusting the tension of the rope lines. In collapsing the rent, the user must disassemble the anchors and the rope lines, fold the tent and fit the membrane, the rope lines and the support pole in a casing.

To overcome the disadvantages of such conventional tents, some tent manufacturers have provided collapsible tents with resilient supports embedded in the tent membrane to alleviate the need for a support pole and anchoring rope lines. Such collapsible tents can be folded and placed in a casing for transport.

However, a disadvantage of such tents is that the resilient supports consist of several separate support members which in most cases a user must carefully attach to another at several points in order to define the structure of the tent. As such, the user must spend time learning how to attach the tent members together and attach and detach the members every time the tent is erected. Further, the use of many tent members increases the cost of manufacturing, purchase and maintenance of the tent over the life time of the tent. Yet another disadvantage of such tents is difficulty of collapsing the tents into a small assembly. Typically, the user must twist and turn the resilient supports to fold them. This action requires substantial expenditure of time and energy as the resilient supports are usually quite stiff in order to maintain the structural integrity of the tent.

Therefore, there is a need for a collapsible tent without separate support members. There is also a need for such a tent to be self-erecting without the need for assembly. There is also a need for such a tent to be easily collapsible into a small space for transport.

SUMMARY

The present invention satisfies these needs. In one embodiment, the present invention provides a collapsible tent comprising a closed loop resilient coilable member, the member being distorted to form at least three support loops. Each support loop adjoins the other support loops along a single portion of its perimeter with the support loops having a common adjoining region. Each support loop has a perimeter substantially the same as that of the other support loops and a membrane attached to at least a portion of the perimeter of the support loop. The membrane extends between the opposing portions of the support loop to restrain the support loop. The tent further comprises a base membrane attached to at least a portion of the perimeter of each support loop and extending between the support loops to restrain the support loops in relation to one another. When the tent is expanded, the support loops are in spaced relation to one another around the common adjoining point and are restrained by the membranes. The common adjoining point forms an apex of the tent and the membranes define walls and a base of the tent. When the tent is fully collapsed, the support loops form overlapping loops over one another that are coiled.

Preferably, each support loop further comprises attachment means along at least a portion of its perimeter to allow detaching the membrane of the support loop from a portion of the support loop to unrestrain the support loop when collapsing the tent. This allows effortless folding of the support loops in collapsing the tent. More preferably, each support loop further comprises attachment means along at least a portion of its perimeter to allow detaching the base membrane from a portion of said support loop to unrestrain said support loop when collapsing the tent.

The coilable member can include two ends and a connector for connecting the two ends to form a closed loop, the connector comprising a substantially cylindrical shell having a pocket at each end to receive and hold an end of the coilable member.

DRAWINGS

These and other features, aspects, and advantages of the present invention will become better understood with regard to the following description, appended claims, and accompanying drawings which illustrate examples of the invention, where:

FIG. 1 is a perspective view of an embodiment of a collapsible tent according to the present invention shown in expanded configuration;

FIG. 2*a* is a schematic view of the resilient member of the tent of FIG. 1 shown in undistorted form;

FIG. 2*b* is a schematic view of the resilient member of FIG. 2*a* shown in distorted form to form three support loops;

FIG. 2*c* is a perspective view of the support loops of FIG. 2*b;*

FIG. 3*a* is a schematic view of the support loops of FIG. 2*c* being rotated for placement on top of one another to collapse the tent;

FIG. 3*b* is a schematic view of the support loops of FIG. 3*a* rotated on top of one another to collapse the tent;

FIG. 4 is a perspective view of the tent of FIG. 1 showing a door for entering the tent;

FIG. 5*a* is a perspective schematic view of an embodiment of a connector for connecting the ends of a resilient member according to the present invention;

FIG. 5*b* is another perspective view of the connector shown in FIG. 5*a;*

FIG. 5*c* is a perspective schematic view of another embodiment of a connector for connecting the ends of a resilient member according to the present invention;

Figure 6:
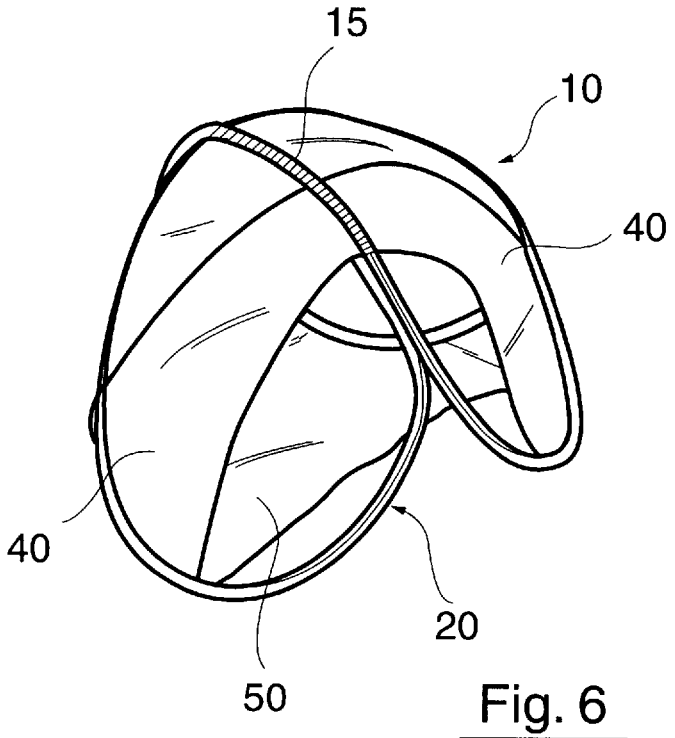
FIG. 6 is a rear perspective view of another embodiment of a collapsible tent according to the present invention shown in expanded configuration.
Figure 8A:
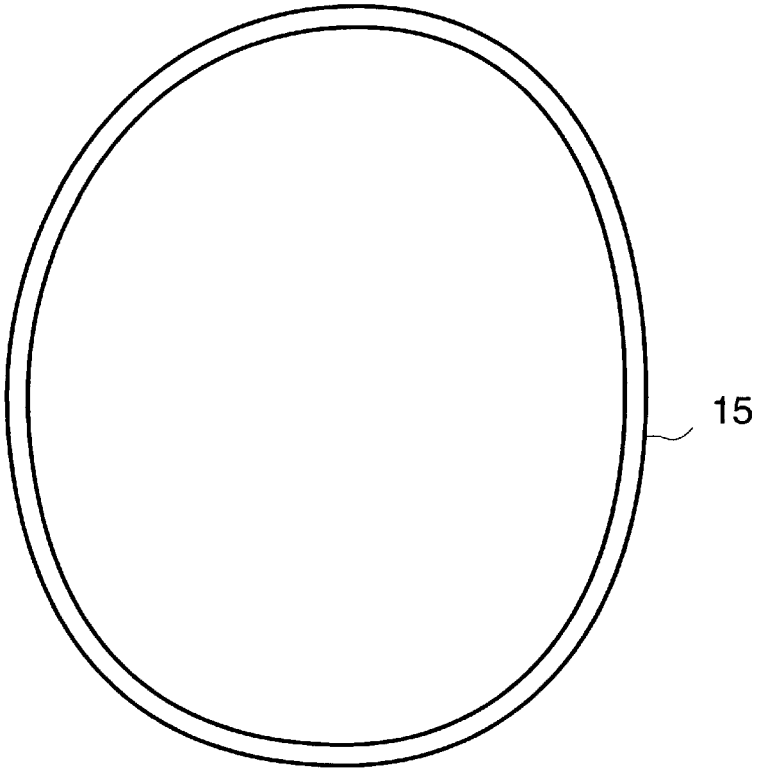
Figure 8B:
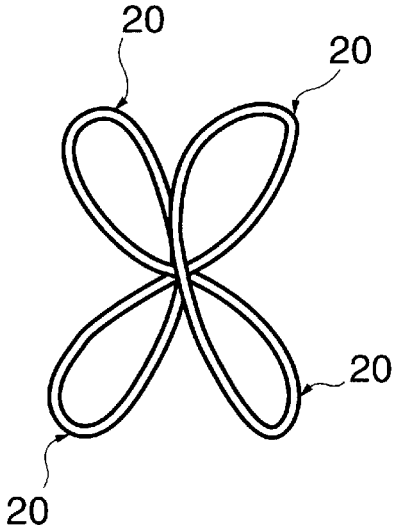
Figure 8C:
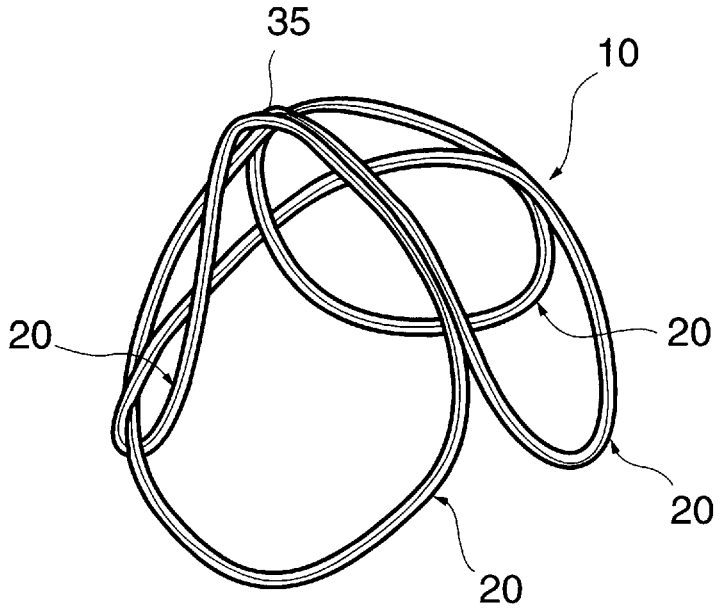

FIG. 8*a* is a schematic view of the resilient member of the tent of FIG. 6 shown in undistorted form;

FIG. 8*b* is a schematic view of the resilient member of FIG. 8*a* shown in distorted form to form four support loops;

FIG. 8*c* is a perspective view of the support loops of FIG. 8*b;*

Figure 9:
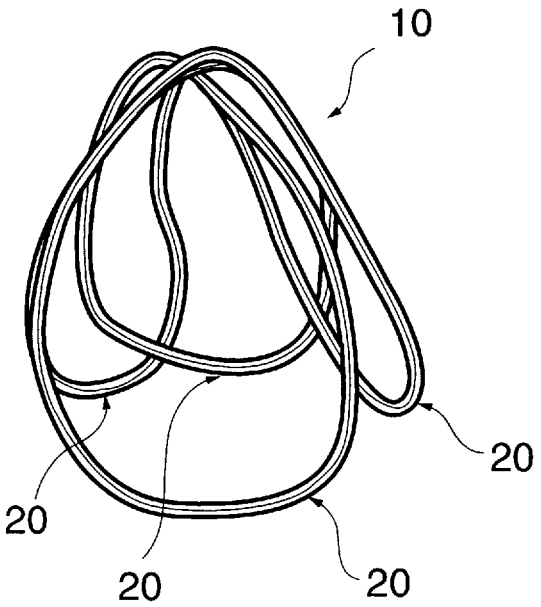
Figure 10:
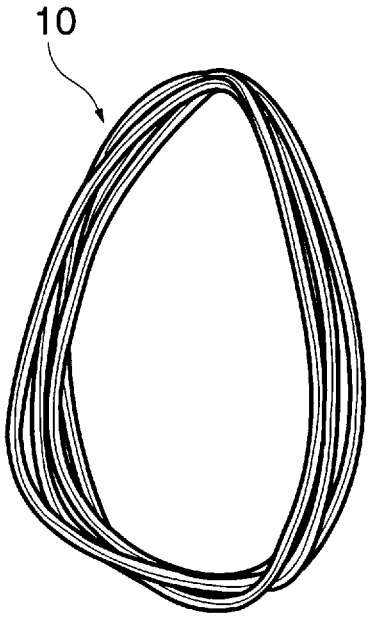

FIG. 9 is a schematic view of the support loops of FIG. 8*c* being rotated for placement on top of one another to collapse the tent; and FIG. 10 is a schematic view of the support loops of FIG. 9 rotated on top of one another to collapse the tent.

DESCRIPTION

Figure 1:
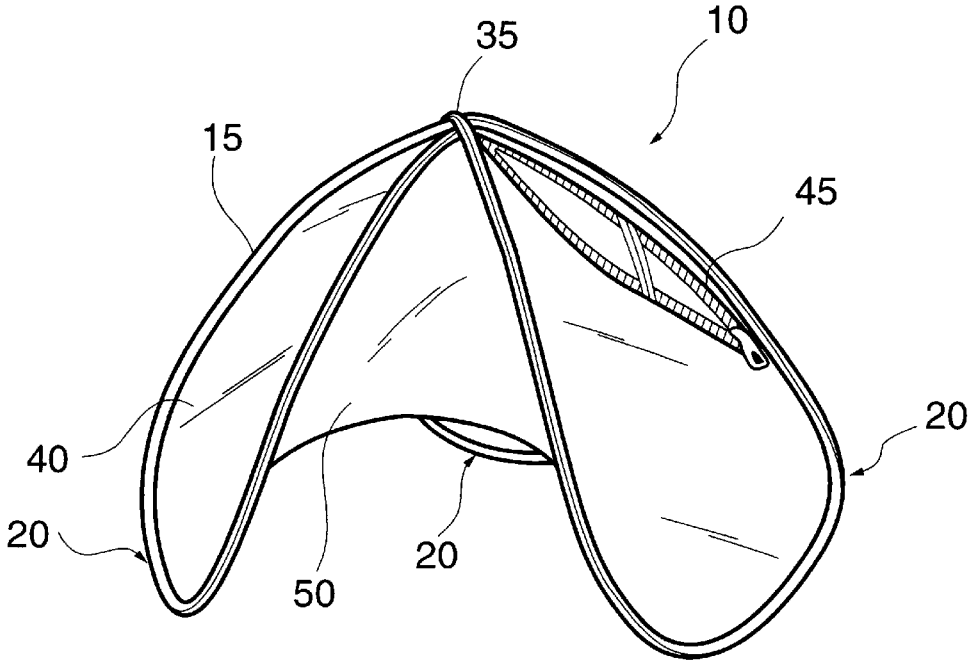
Figure 2A:
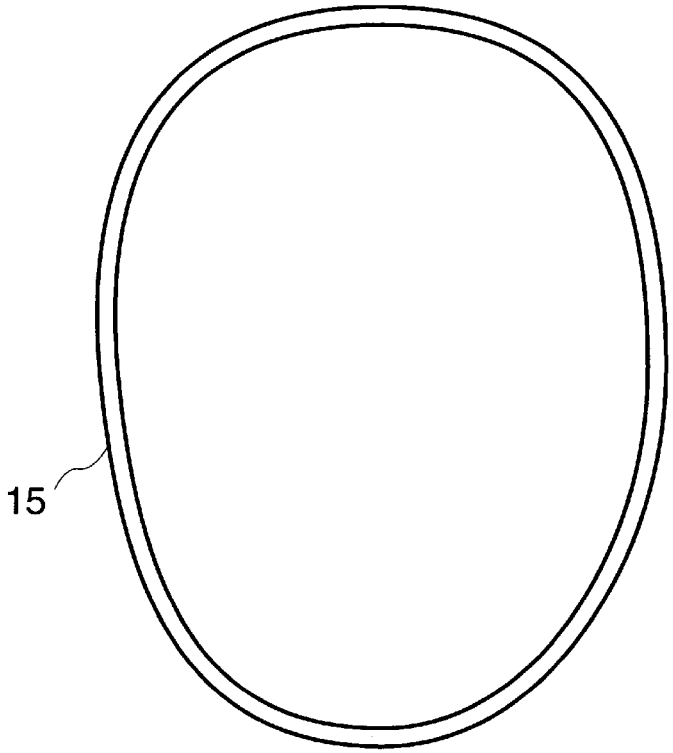
Figure 2B:
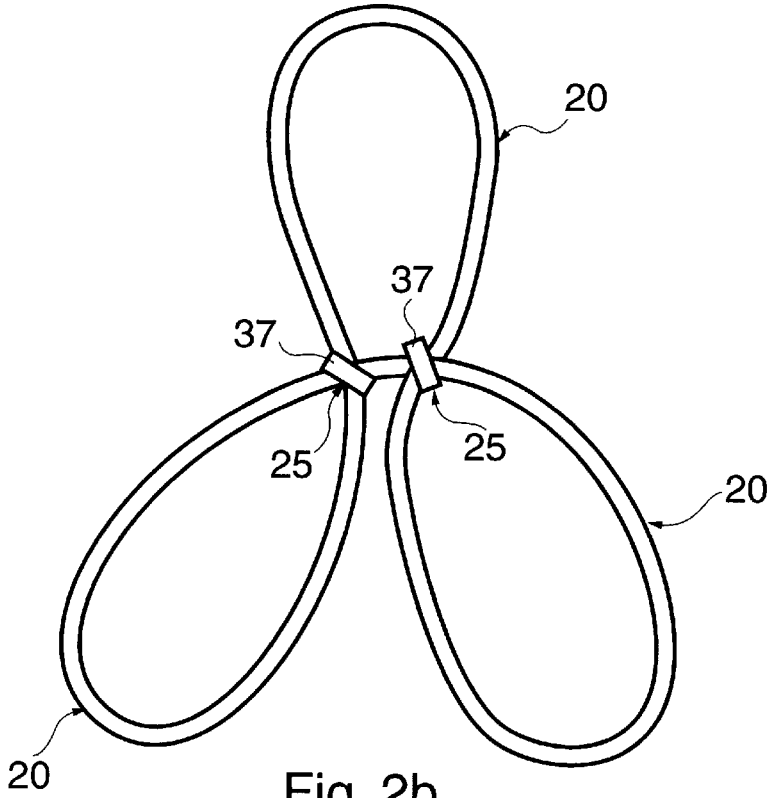
Figure 2C:
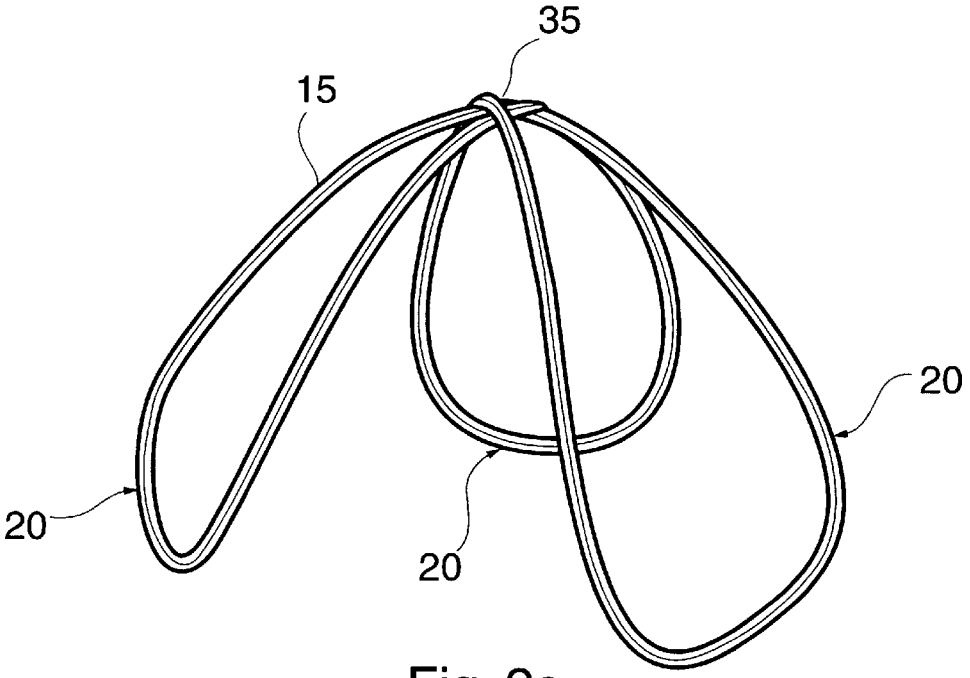
Figure 3A:
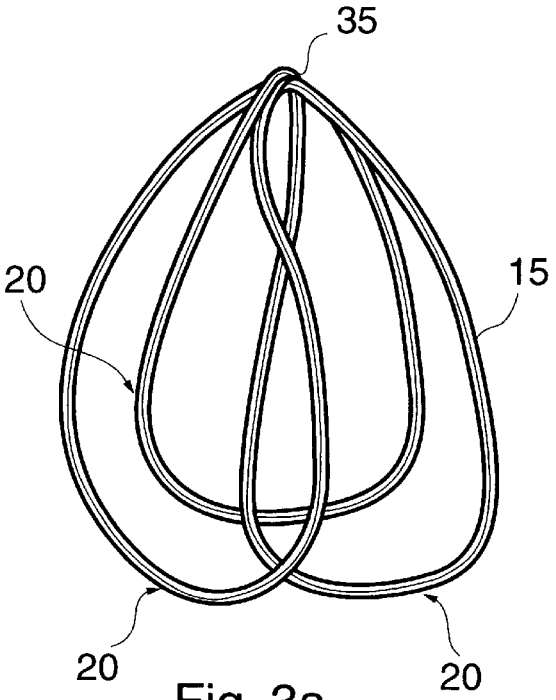
Figure 3B:
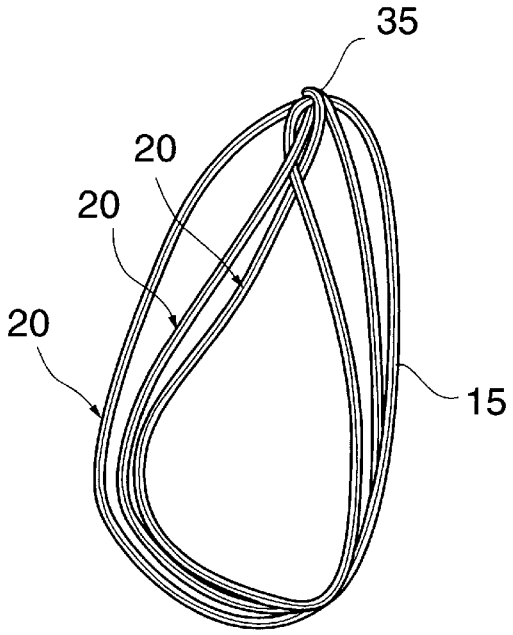

Referring to FIG. 1, a preferred embodiment of a collapsible tent 10 according to the present invention is shown. The collapsible tent 10 comprises a closed loop resilient member 15 having a perimeter 17 and distorted to form at least three support loops 20. In the embodiment of the invention shown in FIG. 1, the resilient member 15 is distorted as shown in FIGS. 2*a* and 2*b* to form three support loops 20 shown in FIG. 2*c*. The resilient member 15 crosses over itself in two cross over locations 25 proximate to one another along the perimeter 17 of the resilient member 15. As such, each support loop 20 adjoins the other support loops along a single portion of its perimeter 30 with the support loops having a common adjoining are 35 defined by the two crossover locations 25. A flexible material 37 is wrapped over the crossing portions of resilient member 15 at each crossing location 25 to hold the crossing portions in place and to provide a flexible joint between the crossing portions of the resilient member 15. This allows the support loops 20 to be rotated and placed on top of one another along their parameters as shown in FIGS. 3*a* and 3*b*.

The perimeter length of each support loop 20 is substantially the same as that of the other support loops 20 to provide a symmetrical structure for the tent 10. Referring to FIG. 1, each support loop 20 also has a membrane 40 attached to at least a portion of the perimeter 30 of the support loop 20. The membrane 40 extends between the opposing portions of the support loop 20 to restrain the support loop 20. In the drawings, the membrane 40 is substantially elliptical in shape and constrains the support loop 20 into an elliptical shape. Other membrane shapes such as oval, circular, rectangular, triangular and the like are also possible as is recognized by practitioners in the art.

Preferably, each support loop 20 further comprises attachment means 45 along at least a portion of its perimeter 30 to allow detaching the membrane 40 of the support loop 20 from a portion of the support loop 20. When the membrane 40 is fully attached to the support loop 20, it enhances the rigidity of the support loop 20 against twisting and bending. This is because the membrane 40 restrains the support loop 20 into a particular shape which resists twisting and bending against the pull of the membrane 40 on the perimeter 30 of the support loop 20. By detaching at least a portion of the membrane 40 from the support loop 20, the rigidity of the support loop 20 is decreased and the support loop 20 can be easily twisted and bent to allow effortless folding of the support loop 20.

The attachment means 45 can include detachable fasteners such as a zipper extending along a portion of the perimeter 30 of the support loop 20 and the membrane 40. The fasteners can also include hook and loop materials such as Velcro (TM). Preferably the fasteners are weather resistant to prevent leakage of water and the like into the tent through the fasteners. In the embodiment of the tent 10 shown in FIG. 1, the attachment means 45 comprises a zipper extending along a portion of the perimeter 30 of the support loop 20 proximate the adjoining region 35 of the support loop 20. Preferably, the zipper is placed substantially in the same relative location along the perimeter 30 of each support loop 20, such that when the support loops 20 are rotated and placed on top of one another, the support loops 20 can be collectively twisted and bent along the same points on their perimeter 30 in order to easily fold the tent 10 by collectively coiling the support loops 20. Typically, the support loops 20 can be collectively coiled into three overlapping rings.

The tent 10 further comprises a base membrane 50 having a perimeter 55 attached to at least a portion of the perimeter 30 of each support loop 20 and extending between the support loops 20 to restrain the support loops 20 in relation to one another. The size and shape of the base membrane 50 defines the spacing of the support loops 20 in relation to one another and the height of the tent 10 when the tent 10 is expanded. This is because without the base membrane 50 the support loops 20 assume a spatial position with respect to one another, such as a planar form, with minimum potential energy stored in the resilient member 15. In the embodiment of the tent 10 shown in FIG. 1, the base membrane 50 is sized and shaped such that the support loops 20 are in symmetrical spaced relation to one another around the common adjoining region 35 and are restrained in relation to one another by the base membrane 50. The common adjoining region 35 forms an apex 60 of the tent 10 with the support loop membranes 40 and the base membrane 50 defining walls 65 and a base 70 of the tent 10. As such, the present invention provides a self-erecting free-standing tent 10 with only one resilient member 15 which does not require any assembly by a user.

Preferably, the tent 10 further comprises attachment means 45 along at least a portion of the perimeter 55 of the base membrane 50 to allow detaching the base membrane 50 from a portion of each support loop 20 to unrestrain the support loops 20 in relation to one another. When the base membrane 50 is fully attached to the support loops 20, it enhances the rigidity of the support loops 20 in relation to each other against twisting and bending. This is because the base membrane 50 restrains the support loops 20 into a particular spatial arrangement which resists twisting and bending against the pull of the base membrane 50 on the perimeters 30 of the support loops 25. By detaching at least a portion of the base membrane 50 from the support loops 20, the support loops 20 can be easily twisted and bent to allow effortless folding of the support loops 20. The attachment means 45 can comprise a zipper or other means as described above.

In the embodiment of the tent 10 shown in FIG. 1, the attachment means 45 for the support loop membranes 40 and the attachment means 45 for the base membrane 50 comprise a zipper for each support loop 20. The zipper detachably attaches a portion of the support loop membrane 40 and a portion of the base membrane 50 to the perimeter 30 of the support loop 20 proximate the common adjoining region 35. For each support loop 20, this allows simultaneous attaching and detaching of the support loop membrane 40 and the base membrane 50 from a portion of the perimeter 30 of the support loop 20. This is advantageous because it minimizes the number of attachment means 45 necessary for each support loop 20 and focuses the location of detachment of the membranes 40 and 50 from each support loop 20 to the same location along the perimeter 30 of the support loop 20 to easily bend and twist the support loop 20 around that location. In this case, each zipper extends along about $1/6^{th}$ of the perimeter 30 of a corresponding support loop 20. Other zipper lengths are also possible to provide more or less flexibility of the support loops 20 as is recognized by the practitioners in the art.

Figure 4:
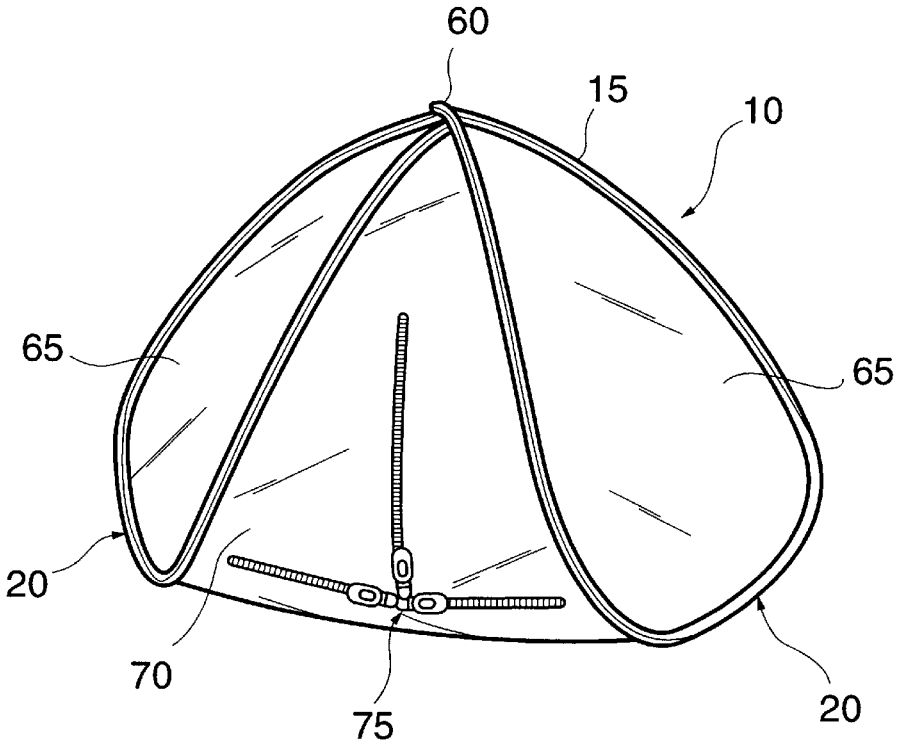

The membranes 40 and 50 can be of canvas, duck or lightweight material suitable for privacy and wind or rain protection as recognized by practitioners in the art. Openings 75 in the membranes 40 and 50 forming the walls 65 of the tent 10 can be provided to serve as doors and windows of the tent 10. For example, one of the membranes 40 forming a wall 65 of the tent 10 can include a zippered opening to serve as a door for the tent 10 as shown in FIG. 4. One of more of the membranes 40 and 50 forming the walls of the tent 10 can include a closable opening forming a window for the tent 10.

The resilient member 15 is a coilable material with sufficient flexibility to allow distortion into the support loops 20. The resilient member 15 can be a sheet or spring steel stock covered by a sleeve. Such material tends to resiliently urge itself back towards its resting position, which in the case of the support loops 20 is elliptical shapes. To erect the tent 10, the coiled tent 10 is released from its carrying case and upon release the tent 10 self-erects into the form shown in FIG. 1. The zippers along the support loop membranes 40 and the base membrane 50 are then zipped up. When collapsing the tent 10, the zippers along the support loop membranes 40 and the base membrane 50 are unzipped and the support loops 20 are rotated along the common adjoining region 35 and placed on top of one another along their perimeters 30 in a planar form. The support loops 20 are then collectively twisted and bent along the same points on their perimeters 30 into a coil having three turns. The coil is stable for handling such as placement inside a carrying case shaped and sized to receive the coil and snugly fit around the coil.

The length and thickness of the resilient member 15 depends on the shape and volume of the tent 10. For a larger tent, the resilient member 15 is longer and thicker to provide a larger support structure and to maintain the structural integrity of the tent 10.

Figure 5A:
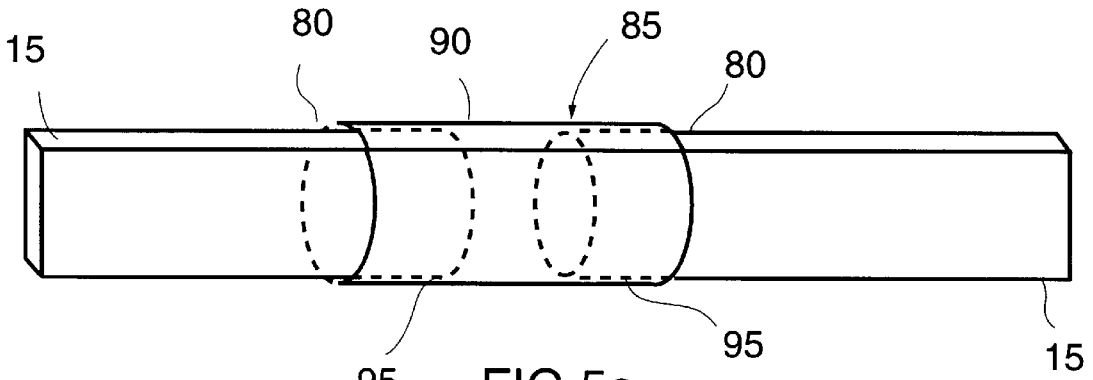
Figure 5B:
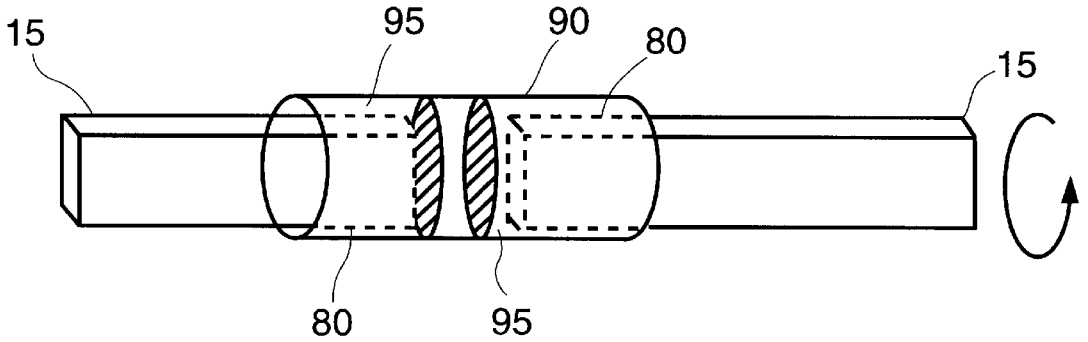
Figure 5C:
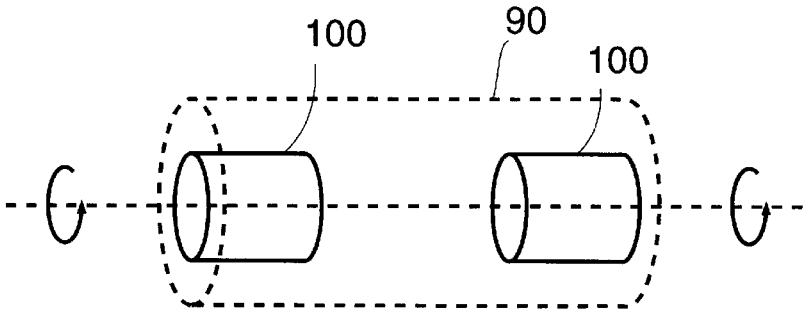

The resilient can be continuous and forms a closed loop. Referring to FIGS. 5a and 5b, preferably, the resilient member 15 includes two ends 80 and a connector 85 for connecting the two ends 80 to form a closed loop. Preferably, the connector 85 comprises a substantially cylindrical shell 90 having a pocket 95 at each end. Each pocket 95 is shaped and size to receive and hold an end 80 of the coilable member 15. Preferably, at least one of the pockets 95 allows an end 80 of the coilable member 15 to axially rotate in the shell 90. When the resilient member 15 is twisted, it causes at least one of its ends 80 to twist and freely rotate in the pocket 95, allowing the resilient member 15 to be freely twisted. This allows axial twisting of the coilable member 15 when collapsing or erecting the tent 10. FIG. 5*c* shown another example embodiment of the connector 85 comprising the shell 90 and casings 100 rotatably disposed in the cylindrical shell 90. At least one of the casings 100 has an axis of rotation concentric with the axis of the cylindrical shell 90 and the axis of the resilient member 15. When the resilient member 15 is twisted, it causes at least one of its ends 80 to twist and freely rotate the casing 100 in the cylindrical shell 90, allowing the resilient member 15 to be freely twisted.

Figure 7:
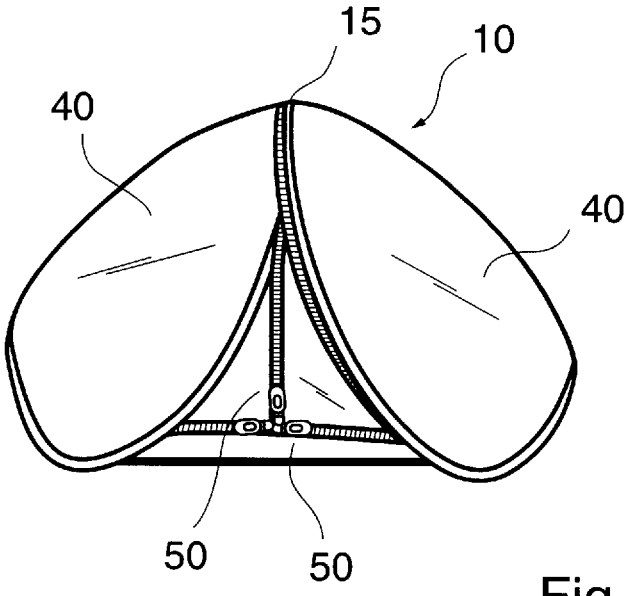
FIG. 7 is a front perspective view of the tent of FIG. 6.

In another embodiment of a tent 10 according to the present invention shown in FIGS. 6 and 7, the resilient member 15 is distorted to form four support loops 20 as shown in FIGS. 8*a*–8*c*. Each support loop 20 adjoins the other support loops 20 along a single portion of its perimeter 30. The support loops 20 are substantially elliptical in shape and have a common adjoining region 35. A flexible material can be wrapped over the crossing portions of resilient member 15 at each crossing point as described above to hold the crossing portions in place and to provide a flexible joint between the crossing portions of the resilient member 15. This allows the support loops 20 to be rotated and placed on top of one another along their perimeters 30 as shown in FIGS. 9 and 10.

Referring to FIGS. 6 and 7, the perimeter lengths of the support loops 20 are substantially the same as that of the other support loops 20. A membrane 40 is attached to at least a portion of the perimeter 30 of each support loop 20, extending between the opposing portions of the support loop 20 to restrain the support loop 20. Preferably, the membrane 40 includes attachment means 45 along at least a portion of its perimeter 30 to allow detaching the membrane 40 from a portion of the support loop 20 to unrestrain the support loop 20 when collapsing the tent 10.

The tent 10 further comprises a base membrane 50 attached to at least a portion of the perimeter 30 of each support loop 20 and extending between the support loops 20 to restrain the support loops 20 in relation to one another. Preferably, the base membrane 50 has attachment means 45 along at least a portion of its perimeter with each support loop 20 to allow detaching the base membrane 50 from a portion of said support loop 20 to unrestrain said support loop 20 when collapsing the tent 10.

Although the present invention has been described in considerable detail with regard to the preferred versions thereof, other versions are possible. Therefore, the appended claims should not be limited to the descriptions of the preferred versions contained herein.

What is claimed is:

1. A collapsible tent comprising a closed loop resilient coilable member, the member being distorted to form at least three support loops, each support loop adjoining the other support loops along a single portion of its perimeter, the support loops having a common adjoining region, each support loop having a perimeter substantially the same as that of the other support loops and a membrane attached to at least a portion of the perimeter of the support loop and extending between the opposing portions of the support loop to restrain the support loop, the tent further comprising a base membrane attached to at least a portion of the perimeter of each support loop and extending between the support loops to restrain the support loops in relation to one another;

wherein, when the tent is expanded, the support loops are in spaced relation to one another around the common adjoining region and restrained by the membranes, the common adjoining region forming an apex of the tent and the membranes defining walls and a base of the tent.

2. The tent of claim 1 wherein at least one support loop further comprises attachment means along at least a portion of its perimeter to allow detaching the membrane of the support loop from a portion of the support loop to unrestrain the support loop when collapsing the tent.

3. The tent of claim 2 wherein the attachment means of said support loop is positioned along the perimeter of the support loop proximate the common adjoining region on the perimeter of the support loop.

4. The tent of claim 1 wherein at least one support loop further comprises attachment means along at least a portion of its perimeter to allow detaching the base membrane from a portion of said support loop to unrestrain said support loop when collapsing the tent.

5. The tent of claim 4 wherein the attachment means of said support loop is positioned along the perimeter of the support loop proximate the common adjoining region on the perimeter of the support loop.

6. The tent of claim 1 wherein when the tent is collapsed, the support loops form overlapping loops over one another that can be coiled.

7. The tent of claim 1 wherein each support loop is substantially elliptical in shape.

8. The tent of claim 1 wherein the coilable member is continuous.

9. The tent of claim 1 wherein the coilable member includes two ends and a connector for connecting the two ends to form a closed loop, the connector comprising a substantially cylindrical shell having a pocket at each end, each pocket receiving and holding an end of the coilable member, at least one of the pockets allowing an end of the coilable member to axially rotate in the shell.

10. A collapsible tent comprising a closed loop resilient coilable member, the member being distorted to form three support loops, each support loop adjoining the other support loops along a single portion of its perimeter, the support loops being substantially elliptical in shape and having a common adjoining region, each support loop having a perimeter substantially the same as that of the other support loops and a membrane attached to at least a portion of the perimeter of the support loop and extending between the opposing portions of the support loop to restrain the support loop, at least one of said support loop membranes including attachment means along at least a portion of its perimeter to allow detaching the membrane from a portion of the support loop to unrestrain the support loop when collapsing the tent, the tent further comprising a base membrane attached to at least a portion of the perimeter of each support loop and extending between the support loops to restrain the support loops in relation to one another, the base membrane having attachment means along at least a portion of its perimeter with each support loop to allow detaching the base membrane from a portion of said support loop to unrestrain said support loop when collapsing the tent;

wherein, when the tent is expanded, the support loops are in spaced relation to one another around the common adjoining region and restrained by the membranes, the common adjoining region forming an apex of the tent and the membranes defining walls and a base of the tent.

11. The tent of claim 10 wherein the attachment means of said at least one membrane is positioned along the perimeter of the corresponding support loop proximate the common adjoining region on the perimeter of the support loop.

12. The tent of claim 10 wherein the attachment means of the base membrane are positioned along the perimeter of the base membrane proximate the common adjoining region on the perimeter of each support loop.

13. The tent of claim 10 wherein the coilable member includes two ends and a connector for connecting the two ends to form a closed loop, the connector comprising a substantially cylindrical shell having a pocket at each end, each pocket receiving and holding an end of the coilable member, at least one of the pockets allowing an end of the coilable member to axially rotate in the shell.

14. The tent of claim 10 wherein when the tent is collapsed, the support loops form overlapping loops over one another that can be coiled.

15. A collapsible tent comprising a closed loop resilient coilable member, the member being distorted to form four support loops, each support loop adjoining the other support loops along a single portion of its perimeter, the support loops being substantially elliptical in shape and having a common adjoining region, each support loop having a perimeter substantially the same as that of the other support loops and a membrane attached to at least a portion of the perimeter of the support loop and extending between the opposing portions of the support loop to restrain the support loop, at least one of said support loop membranes including attachment means along at least a portion of its perimeter to allow detaching the membrane from a portion of the support loop to unrestrain the support loop when collapsing the tent, the tent further comprising a base membrane attached to at least a portion of the perimeter of each support loop and extending between the support loops to restrain the support loops in relation to one another, the base membrane having attachment means along at least a portion of its perimeter with each support loop to allow detaching the base membrane from a portion of said support loop to unrestrain said support loop when collapsing the tent;

wherein, when the tent is expanded, the support loops are in spaced relation to one another around the common adjoining region and restrained by the membranes, the common adjoining region forming an apex of the tent and the membranes defining walls and a base of the tent.

16. The tent of claim 15 wherein the attachment means of said at least one membrane is positioned along the perimeter of the corresponding support loop proximate the common adjoining region on the perimeter of the support loop.

17. The tent of claim 15 wherein the attachment means of the base member are positioned along the perimeter of the base member proximate the common adjoining region on the perimeter of each support loop.

18. The tent of claim 15 wherein the coilable member includes two ends and a connector for connecting the two ends to form a closed loop, the connector comprising a substantially cylindrical shell having a pocket at each end, each pocket receiving and holding an end of the coilable member, at least one of the pockets allowing an end of the coilable member to axially rotate in the shell.

19. The tent of claim 15 wherein when the tent is collapsed, the support loops form overlapping loops over one another that can be coiled.

* * * * *